US010427767B1

(12) United States Patent
Langlois

(10) Patent No.: US 10,427,767 B1
(45) Date of Patent: Oct. 1, 2019

(54) LOCKING SYSTEM FOR ASSISTING AND SUPPORTING AN ACTUATOR OF A TRIM-TAB OF A WATERCRAFT IN THE DESIRED MODE

(71) Applicant: Joseph R. Langlois, Coral Springs, FL (US)

(72) Inventor: Joseph R. Langlois, Coral Springs, FL (US)

( * ) Notice: Subject to any disclaimer, the term of this patent is extended or adjusted under 35 U.S.C. 154(b) by 0 days.

(21) Appl. No.: 16/247,915

(22) Filed: Jan. 15, 2019

(51) Int. Cl.
*B63B 39/00* (2006.01)
*B63B 39/06* (2006.01)

(52) U.S. Cl.
CPC ..... *B63B 39/061* (2013.01)

(58) Field of Classification Search
CPC ..... B63B 39/061
See application file for complete search history.

(56) References Cited

U.S. PATENT DOCUMENTS 3,370,561 A * 2/1968 Ilon ..... B63B 39/061 114/285
3,783,817 A * 1/1974 Banner ..... B63B 39/061 114/285
4,171,113 A * 10/1979 Townsend ..... B64C 13/30 244/221
4,603,894 A * 8/1986 Osenkowski ..... B60J 5/0416 292/216
4,605,251 A * 8/1986 Finlay ..... E05C 19/18 292/147
5,524,567 A * 6/1996 Astley ..... B63B 39/061 114/286
5,609,371 A * 3/1997 Mader ..... E05B 17/2015 292/164
6,167,830 B1 * 1/2001 Pilger ..... B63B 39/061 114/285
7,942,711 B1 * 5/2011 Swan ..... B63B 39/061 440/61 D
9,802,688 B1 * 10/2017 Tuchscherer ..... B63H 20/10
2012/0107039 A1 * 5/2012 McClelland ..... F16C 11/04 403/122

* cited by examiner

*Primary Examiner* — Stephen P Avila
(74) *Attorney, Agent, or Firm* — Melvin K. Silverman

(57) ABSTRACT

A locking system for assisting and supporting actuators of a trim-tab system, including a locking rod (20), slideable within a first slotted rod sleeve (28) into a locking dock within the sliding block (24). The invention further includes a second slotted rod sleeve (30) connected to a bottom side of the first slotted rod sleeve (28), a rotating rod (32) within second slotted rod sleeve (30) rotatable towards and away from the sliding block (24). The rotating rod (32) also contains a top driving rod (36) at one end, a bottom rotating rod (38) at an opposite end, and a perpendicular center driving rod (42) at the front-center side of the rotating rod (32). The center driving rod (42) moves the locking rod through contact with a thrusting rod (48). The sliding block (24) further contains a bottom contact rod (40) and a top contact rod (38).

10 Claims, 2 Drawing Sheets

LOCKING SYSTEM FOR ASSISTING AND SUPPORTING AN ACTUATOR OF A TRIM-TAB OF A WATERCRAFT IN THE DESIRED MODE

FIELD OF THE INVENTION

The present invention relates to an improvement in classical trim-tab technology to enhance the general hydrodynamic performance of a watercraft inclusive of the fuel efficiency and strength of the actuation device thereof.

BACKGROUND OF THE INVENTION

So-called boat leveling devices of the trim-tab type have been known for many years and various forms of them have been developed in an effort to increase attitude control and stability of water crafts, as well as improving general hydrodynamic efficiency inclusive of decrease of flow velocity under the hull and fuel efficiency.

In a typical trim-tab system, the tabs themselves are controlled with an actuator device. Actuators types range from mechanical actuators, electrical actuators, electro-mechanical actuators, and hydraulic actuators. With every single actuation system in a trim-tab set up comes an inherent maximum force that the actuator can withstand. Take an electro-mechanical actuator for example, typically seen on a yacht of about 36 feet in length, where the electro-mechanical outfit uses a worm drive to raise and lower the actuator ram, which is in connection with a trim-tab, therefore putting the trim-tab in its desired angle of deflection. When the tab is in a down position, any angle other than zero degrees, the force of the water coming in contact with the tab increases with speed and higher angle of deflection. In this example, there are two trim-tabs and each having two actuators. The actuators for a watercraft of this length typically can withstand 3,500-4,000 pounds of force per actuator. If one of those trim-tab actuators were to fail, there is not much beyond the second actuator holding the tab in place, and this could begin to change deflection angle unexpectedly as the other actuator typically could not withstand the force. A need arises in a case such as this wherein a locking mechanism such as the present invention would prevent further issue with the loss of trim-tab system function where an actuator fails.

Currently in the art, the only way to lock a trim-tab in place is with the actuation device itself. Looking at the system in Weiler, U.S. Pat. No. 3,463,109 (1968), a trim tab system is shown to have a hydraulic actuator controlling the position of the angle of deflection. The hydraulic actuator is essentially what keeps the actuator in its place while the watercraft is in motion.

Another prior art trim-tab system is that which is disclosed in Crews, Jr., U.S. Pat. No. 5,881,666 (1997), teaches an electro-mechanical trim-tab system utilizing an electric motor to drive a gearbox and a threaded shaft in an actuator to raise and lower a ram to get the trim-tab to a desired angle of deflection. The gearbox and electric motor are what keeps the trim-tab in place while the watercraft is moving.

A third prior art trim-tab system in Pilger, U.S. Pat. No. 6,167,830 (1999), discloses a fully mechanical trim-tab actuator that uses an adjustment rod with a pivot hole to lock the trim-tab in its desired angle of deflection, with a screw and nut, at different points along the adjustment rod. This does not need the assistance of any hydraulic or electro-mechanical system.

What all three prior-art systems have in common is the use of the actuator itself to effectively lock the trim-tab in its desired place and it is not to move until the actuator is engaged to lift or drop the tab. What is lacking in all trim-tabs types of the likes above is a fail-safe, therefore creating a need. If the existing actuator in all three prior art systems were to fail, the trim tab will no longer be in its desired angle as it is free to move about the hinging point that is typical in a trim-tab system.

The instant invention discloses a trim-tab locking system. It is an object of the instant invention to provide a fail-safe for common trim-tab actuators in the event that there is an actuator failure.

The instant invention also sets forth to add strength to the overall trim-tab system and alleviate substantial stresses and forces that the actuator would be under without the instant invention.

SUMMARY OF THE INVENTION

The instant invention relates to a locking system for assisting and supporting an actuator of a trim-tab system, comprising a locking rod positioned within a first slotted rod sleeve, wherein said locking rod can slidably move through said slotted rod sleeve and into a locking dock. A rotating rod is sleeved within a second slotted rod sleeve, wherein said rotating rod further includes a top driving rod fixed at one distal end of the rotating rod, the rotating rod further including a bottom driving rod fixed at the opposite end of the rotating rod. The rotating rod also has a center perpendicular driving rod fixed at a substantially front-center side of the rotating rod, the rotating rod rotatable within the slotted rod sleeve. Said first slotted rod sleeve and said second slotted rod sleeve are both fixed to a sliding block, the sliding block moveable in the upward and downward directions. A first contact block fixed to the sliding block itself at a proximal end of a substantial center of a side inner surface of the sliding block, the housing also has a second contact block fixed to the sliding block at a proximal end at a substantial center of a side inner surface of the sliding block. A thrusting rod is connected at a backside of the locking rod, the thrusting rod having stability rods spaced at substantially the width of the center perpendicular rod. An elongate substantially planar surface is positioned parallel to the bottom side of a hull of a watercraft, said elongate substantially planar surface is connected to the sliding block and is retractable with the sliding block through the motion of the actuator. A lock housing is mountable to the hull of the watercraft.

The system further comprises actuators of the mechanical, electrical, electro-mechanical, hydraulic, and manual types.

To assist in stability, the system further comprises counterweights at each end of the top-side of the rotating rod.

In a preferred embodiment, the sliding block mentioned above is connected at a back side of said second slotted rod sleeve and the first slotted rod sleeve is connected at a bottom side to the top side of said second slotted rod sleeve. The first slotted rod sleeve is further connected on the bottom side to the top side of the sliding block.

It is an objective of this invention to assist in bearing the force and stresses that would normally exhibit on the actuators.

The aforementioned objects, features, and advantages of the invention will, in part, be pointed out with particularity, from the following drawings, Detailed Description of the Invention, and Claims herewith.

DETAILED DESCRIPTION OF CERTAIN EMBODIMENTS

Figure 2:
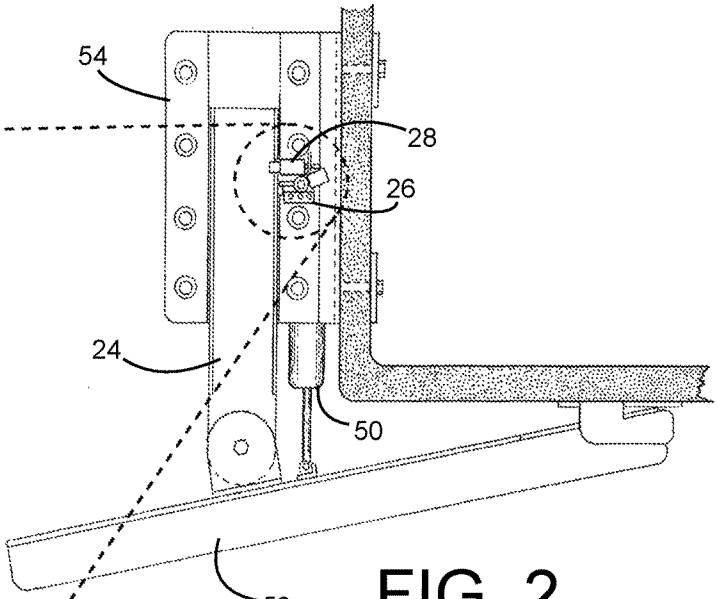
FIG. 2 is a conceptual view of the present invention in the locked position.

For a more complete understanding of the present invention and advantages thereof, reference is now made to the following description of various illustrative and non-limiting embodiments thereof, taking in conjunction with the accompanying drawings in which like reference numbers indicate like features.

The preferred embodiment is noted in FIGS. 1, 2, 3, and 4. Looking to FIG. 1, a locking rod 20 can be seen sliding into a locking dock 22 located on the sliding block 24. The locking rod 20 is capably slideable both inward towards the sliding block 24, also outward away from the sliding block 24, locking and unlocking the rod. The locking rod 20 is slotted within a first slotted rod sleeve 28, which is rigidly fixed to a second slotted rod sleeve 30, rigidly fixed on a lock mount 26. Within the second slotted rod sleeve sits a rotating rod 32, rotatable within the desired constraints for what the range of motion to fully slide the locking rod 20 in an out of the locking dock 22 which is housed within said sliding block.

The rotating rod 32 spans horizontally and parallel to the sliding block 24, having at each end two rods: a bottom driving rod 34 and a top 36 driving rod. The bottom surface of the driving rod 36 is designed to a length that can fully contact the top surface of a top contact block 38. The bottom driving rod 34 is designed to a length that can fully contact the bottom surface of the bottom contact block 40. Also along the rotating rod, located on a front-center side, is a perpendicular center driving rod 42. The perpendicular center driving rod 42 uses the motion of the rotating rod 32 to lock the locking rod 20. A thrusting rod 48, which is connected to the front-center face of the locking rod, slots through the perpendicular center driving rod 42. Along the thrusting rod 48 are two sets of stability rods 46 on both sides of the thrusting rod 48 to hold in place the perpendicular center driving rod 42.

Figure 1:
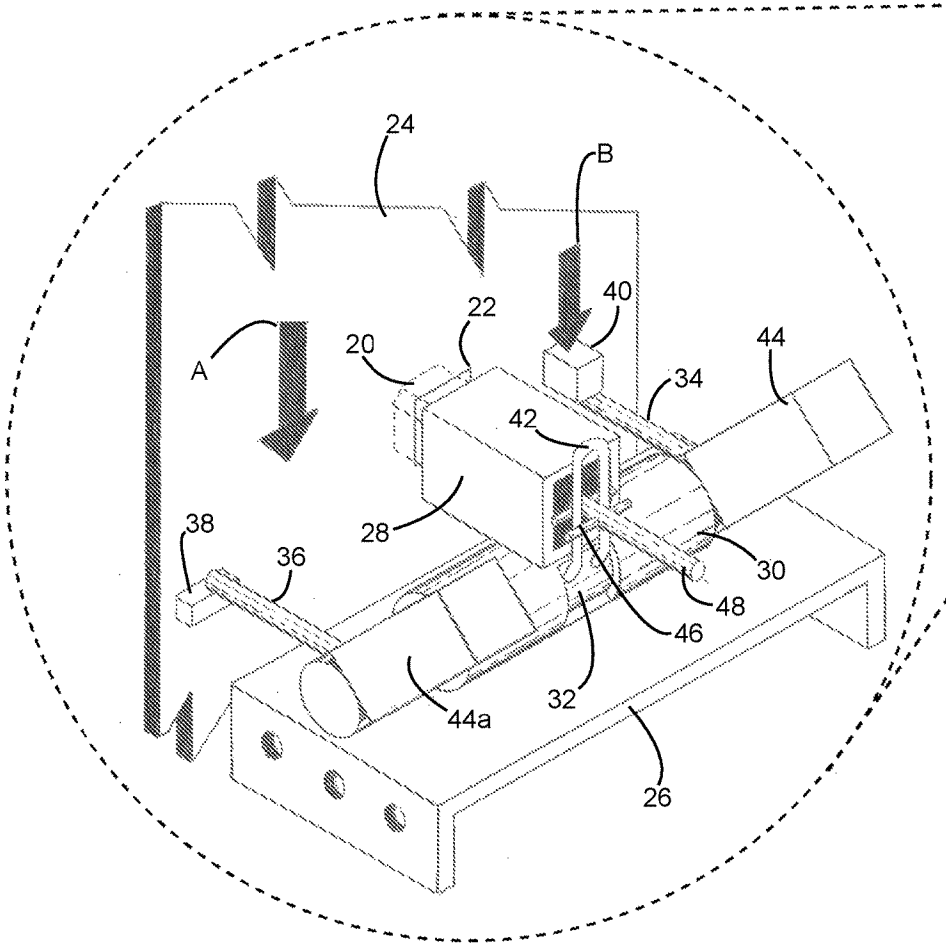
FIG. 1 is a schematic isolated view of the present invention in the locked position.
Figure 3:
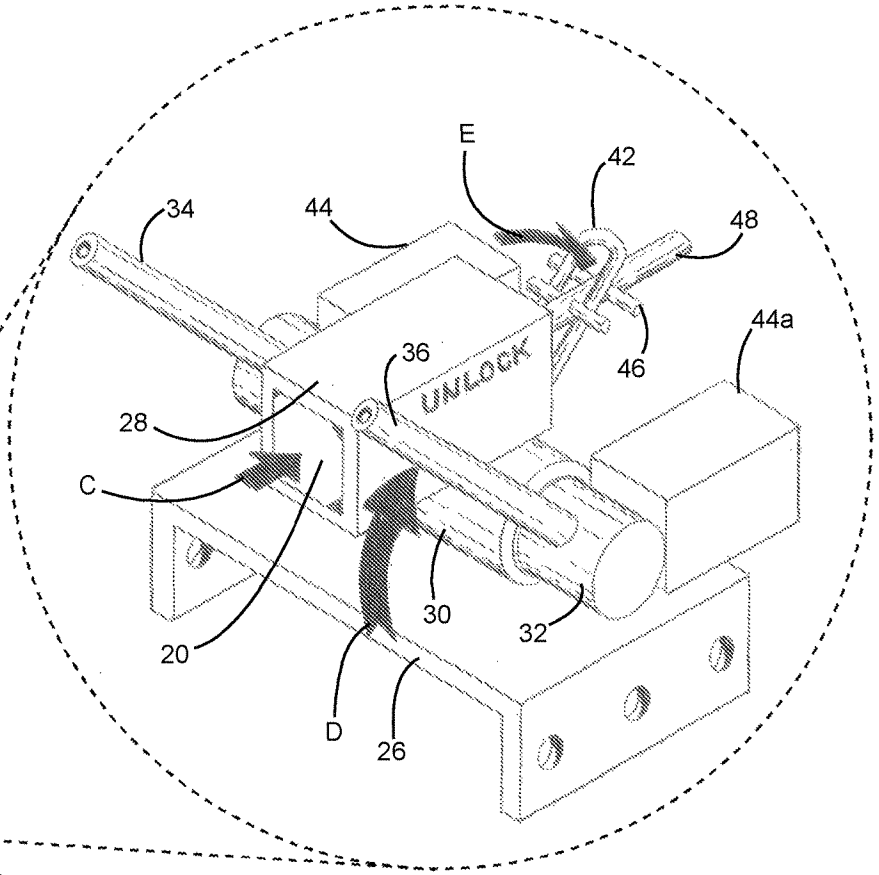
FIG. 3 is a schematic isolated view of the present invention rotating into an unlocked position from a locked position.
Figure 4:
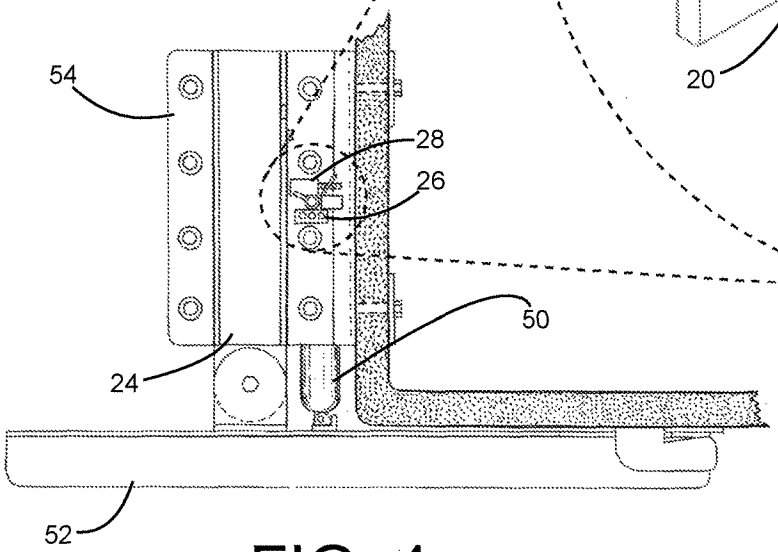
FIG. 4 is a conceptual view of the present invention in the unlocked position.

Typically, when the watercraft is docked in port or in idle, the lock is in the unlocked position as seen in FIGS. 3 and 4. As the watercraft proceeds to leave port and is at a proper depth to reach a cruising speed, the actuation begins. Looking to FIG. 2, the sliding block 24 is the part of the system which connects with a substantially elongate planar surface (trim-tab) 52, moveable by actuator 50, to create motion within the present invention. As the sliding block 24, contained within a housing 54, begins to lower, the bottom driving rod 34 makes substantial contact with the bottom contact block 40, the force of bottom contact block 40 against bottom driving rod 34 gives the rotating rod 32 and inward rotation toward the locking dock 22, as seen in FIG. 1. As the locking rod 20 enters the locking dock 22, the top driving rod 36 beings to approach the top contact block 38, and when the locking rod 20 is fully locked within the locking dock 22, the top driving rod 36 contacts the top contact block 38.

The locking rod 20 and locking dock 22 create the "lock" which allows for the trim-tab 52 to stay in place underneath the hull of the marine craft if an actuator 50 were to fail. The locking dock 22, is more specifically a plug that will be extruded into the sliding block 24 of the hull of watercraft. The locking dock 22 will be extruded to a proper depth and width with an appropriate tolerance, allowing for the locking rod 20 to be able to slide in an out without abrasion, but still allowing for a close fit. As the forces on a trim-tab begin to increase, a trim-tab actuator holding that tab in place begins to experience high forces and stresses acting on it. As mentioned, if a trim-tab system did not have a locking mechanism to assist the actuator, there would not be a fail-safe and the tab-actuator system could completely fail. The lock also exists to relieve the actuator of those stresses and avoid failure at high stress and force.

When a user desires to unlock the system, shown in FIGS. 3 and 4, and move the trim-tab into a zero-degree position, the trim-tab actuator will move in a upward direction, moving the sliding block 24 within the housing 54 and causing substantial contact between the top contact block 38 and the top driving rod 36. This contact facilitates a rotation of the rotating rod 32, within second slotted rod sleeve 30, away from the sliding block 24 until the rotation completes in a completely unlocked state, as shown in FIGS. 3 and 4.

In the preferred embodiment, shown in FIGS. 1 and 3, at the top-side ends of the rotating rod 32 are counterweights 44 and 44*a*. The counterweights 44 and 44*a* assist in causing the rotating motion started in the rotating rod 32. The counterweights 44 and 44*a* are not geometrically specific, and different geometries can be utilized as the primary aspect is the desired weight depending on actuator size for each counterweight 44/44*a*.

The locking dock 22 can be a singular dock or a multiplicity of locking docks depending on desired trim-tab angles of deflection. In an embodiment with a multiplicity of locking docks, it is desirable to also have a multiplicity of top contact blocks 38 and bottom contact blocks 40. The top and bottom contact blocks 38/40 are what drives the motion of the overall lock when contacted by bottom or top driving rods 34/36. Having these top and bottom contact blocks 38/40 removable at location which yield a five-degree, seven-degree, nine-degree, and eleven-degree angle of deflection in the trim tab 52. In this embodiment, there would be holes in which the top and bottom contact blocks 38/40 can be inserted and secured into. The motion of the lock from unlocked to locked will not occur until the contact between the top contact block 38 and top contact rod 36 is made.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

I claim:

1. A system for locking, in and out of place, devices used for attitude control and stabilization of a watercraft, comprising:

(a) a locking rod positioned within a first slotted rod sleeve, wherein said locking rod can slidably move through said slotted rod sleeve and into a locking dock;

(b) a rotating rod, sleeved within a second slotted rod sleeve, said rotating rod further including a top driving rod fixed at one distal end of said rotating rod, said rotating rod further including a bottom driving rod fixed at the opposite distal end of said rotating rod, said rotating rod further including a center perpendicular driving rod fixed at a substantially front-center side of said rotating rod, said rotating rod rotatable within said second slotted rod sleeve;

(c) a sliding block, sliding block moveable in an upward and downward direction, said sliding block having a first contact block fixed to said sliding block at a proximal end at a substantial center of a side inner surface of said sliding block, said housing having a second contact block fixed to said sliding block at proximal end at a substantial center of a side inner surface of said sliding block, said locking dock contained within said sliding block;

(d) a lock mount, said first slotted rod sleeve and said second slotted rod sleeve fixed to said lock mount;

(e) a thrusting rod connected at a rear side of said locking rod, said thrusting rod having stability rods spaced at substantially the width of said center perpendicular driving rod; and (f) a lock housing.

2. The system as recited in claim 1, further comprising: Said lock housing mountable to a hull of a watercraft.

3. The system as recited in claim 1, further comprising: an elongate substantially planar surface positioned parallel to a bottom side of said hull of watercraft, said elongate substantially planar surface connected to said sliding block, said elongate substantially planar surface retractable with said sliding block through an actuator connected to said elongate substantially planar surface.

4. The system as recited in claim 1, wherein said actuator comprises an electro-mechanical type actuator.

5. The system as recited in claim 1, wherein said actuator comprises a mechanical type actuator.

6. The system as recited in claim 1, wherein said actuator comprises an electrical type actuator.

7. The system as recited in claim 1, wherein said actuator comprises a hydraulic type actuator.

8. The system as recited in claim 1, wherein said actuator comprises a manual type actuator.

9. The system as recited in claim 1, wherein said rotating rod has counter weights at each end on a top side of said rotating rod.

10. The system as recited in claim 1, further comprising: said sliding block connected at a rear side of said second slotted rod sleeve; and said first slotted rod sleeve connected at a bottom side to a top side of said second slotted rod sleeve, said first slotted rod sleeve further connected on said bottom side to a top side of said locking mount.

* * * * *